United States Patent [19]

Takahashi

[11] Patent Number: 4,797,644

[45] Date of Patent: Jan. 10, 1989

[54] PROCESSING HEAD FOR ELECTROPHOTOGRAPHIC APPARATUS

[75] Inventor: Kazuo Takahashi, Kanagawa, Japan

[73] Assignee: Fuji Photo Film Co., Ltd., Kanagawa, Japan

[21] Appl. No.: 105,785

[22] Filed: Oct. 8, 1987

[30] Foreign Application Priority Data

Oct. 8, 1986 [JP] Japan ..... 61-239801

[51] Int. Cl.[4] ..... G03G 15/10

[52] U.S. Cl. ..... 355/10; 118/662

[58] Field of Search ..... 355/10; 354/317; 118/659–660, 662

[56] References Cited

U.S. PATENT DOCUMENTS

| | | | |
|---|---|---|---|
| 3,936,854 | 2/1976 | Smith | 355/10 X |
| 4,515,463 | 5/1985 | Plumadore | 355/10 |
| 4,591,543 | 5/1986 | Outsuka et al. | 118/660 X |
| 4,622,915 | 11/1986 | Ohtsuka et al. | 355/10 X |

*Primary Examiner*—Arthur T. Grimley
*Assistant Examiner*—J. Pendegrass
*Attorney, Agent, or Firm*—Sughrue, Mion, Zinn, Macpeak & Seas

[57] ABSTRACT

A process head for use in an electrophotographic apparatus and adapted for conducting developing process with a developer on an electrophotographic film in a developing section of the electrophotographic apparatus. The developing section is surrounded by a seal section. An air pump is provided for supplying the seal section with a seal gas selectively at a low pressure higher than the pressure in the developing section and, hence, capable of preventing developer from leaking out of the developing section and a high pressure higher than the low pressure and high enough to drive the seal gas into the developing section. In consequence, leaking of developer out of the developing section is avoided and the seal gas under the high pressure comes into the developing section so as to ensure the complete removal of unnecessary portion of the developing agent.

13 Claims, 15 Drawing Sheets

PROCESSING HEAD FOR ELECTROPHOTOGRAPHIC APPARATUS

BACKGROUND OF THE INVENTION

1. Field of the Invention

The present invention broadly relates to an electrophotographic apparatus and, more particularly, to a processing head for conducting various types of processing on electrophotographic films.

2. Description of the Related Art

Electrophotographic apparatus has been known in which an image is recorded in a predetermined frame of an electrophotographic film in such a manner that the recorded image can be projected or copied as desired.

The electrophotographic apparatus of the kind mentioned above employs a processing head adapted for conducting various types of processing such as charging/exposure and development on the electrophotographic film. Examples of such a processing head is disclosed in U.S. Pat. Nos. 4,591,543, 4,600,291, 4,622,915, 4,623,240, 4,624,554 and so on.

The processing head disclosed in the above-mentioned publications has a charging/exposure section, a developing section, a drying section and a fixing section which are arranged in series in the mentioned order along the path of feed of the electrophotographic film, at a pitch or interval which corresponds to the pitch of frames on the electrophotographic film.

In the charging/exposure section, the portion of the electrophotographic film located in this section, constituting one frame, is charged and then exposed to an image light from an original, so that an electrostatic latent image corresponding to the pattern of an image carried by the original is formed in this portion of the film. The film is then fed so as to bring the exposed frame to the developing section where a liquid developer is applied to the electrophotographic film so as to develop the latent image thereby making it visible. Subsequently, the frame is brought to the drying section where drying air is blown to the electrophotographic film wetted by the liquid developer so as to remove moisture component from the film. Finally, the frame is brought to the fixing section where the developed image is fixed to the electrophotographic film by means of, for example, a fixing lamp. The whole system of the aforesaid electrophotographic apparatus and a method of recording and retrieval of an image frame are disclosed in U.S. Pat. No. 4,671,648.

In order to sufficiently and uniformly apply the developer to the whole area of the exposed portion of the electrophotographic film, the developing section usually employs a system which applies a certain level of pressure to the developer. It is also a common measure to supply pressurized air to get rid of any surplus developing agent after the supply of the same. In some cases, a control of the pressure of the air is conducted such that, in the beginning period of supply of pressurized air, the air pressure is kept comparatively low so as not to cause the developer to be exfoliated from the electrophotographic film but is elevated in the later period. Unfortunately, however, even the pressurized air at the elevated pressure cannot satisfactory remove portions of the developer sticking in the gaps between the electrophotographic film pressed onto the developing section and the corners of the mask of the developing device. Such unremoved portions of the developer remain as contaminant on the electrophotographic film after the development.

SUMMARY OF THE INVENTION

Accordingly, an object of the present invention is to provide a process head for use in electrophotographic apparatus, capable of ensuring removal of any unnecessary portion of developer, thereby overcoming the above-described problems of the prior art.

To this end, according to the present invention, there is provided a process head for use in an electrophotographic apparatus and adapted to supply a developer to an electrophotographic film in a developing section of the electrophotographic apparatus thereby developing a latent image on the electrophotographic film, the process head comprising: a seal section provided adjacent to the developing section and separated from the developing section by a frame portion which defines the developing section; and seal pressure supply means capable of supplying to the seal section a seal gas selectively at a first pressure which is higher than the pressure in the developing section and, hence, effective to prevent the developer from leaking out the developing section and at a second pressure which is higher than the first pressure and, hence, effective to drive the gas into the developing section from the seal section beyond the frame portion.

Thus, in the process head in accordance with the present invention, the seal pressure supply means selectively supplies a low-pressure seal gas and a high-pressure seal gas to the seal region. When the low-pressure seal gas is being supplied, the developer is prevented from coming into the seal region beyond the framework, because the pressure of this gas is slightly higher than the pressure in the developing section. When the high-pressure gas is being supplied into the seal region, this gas leaks into the developing section beyond the framework so as to ensure a complete removal of the unnecessary portion of the developer and to promote the drying of the portion of the developer attaching to the image frame of the electrophotographic film.

The above and other objects, features and advantages of the present invention will become clear from the following description of the preferred embodiment when the same is read in conjunction with the accompanying drawings.

DESCRIPTION OF THE PREFERRED EMBODIMENT

(General Construction of Electrophotographic Apparatus)

Figure 1:
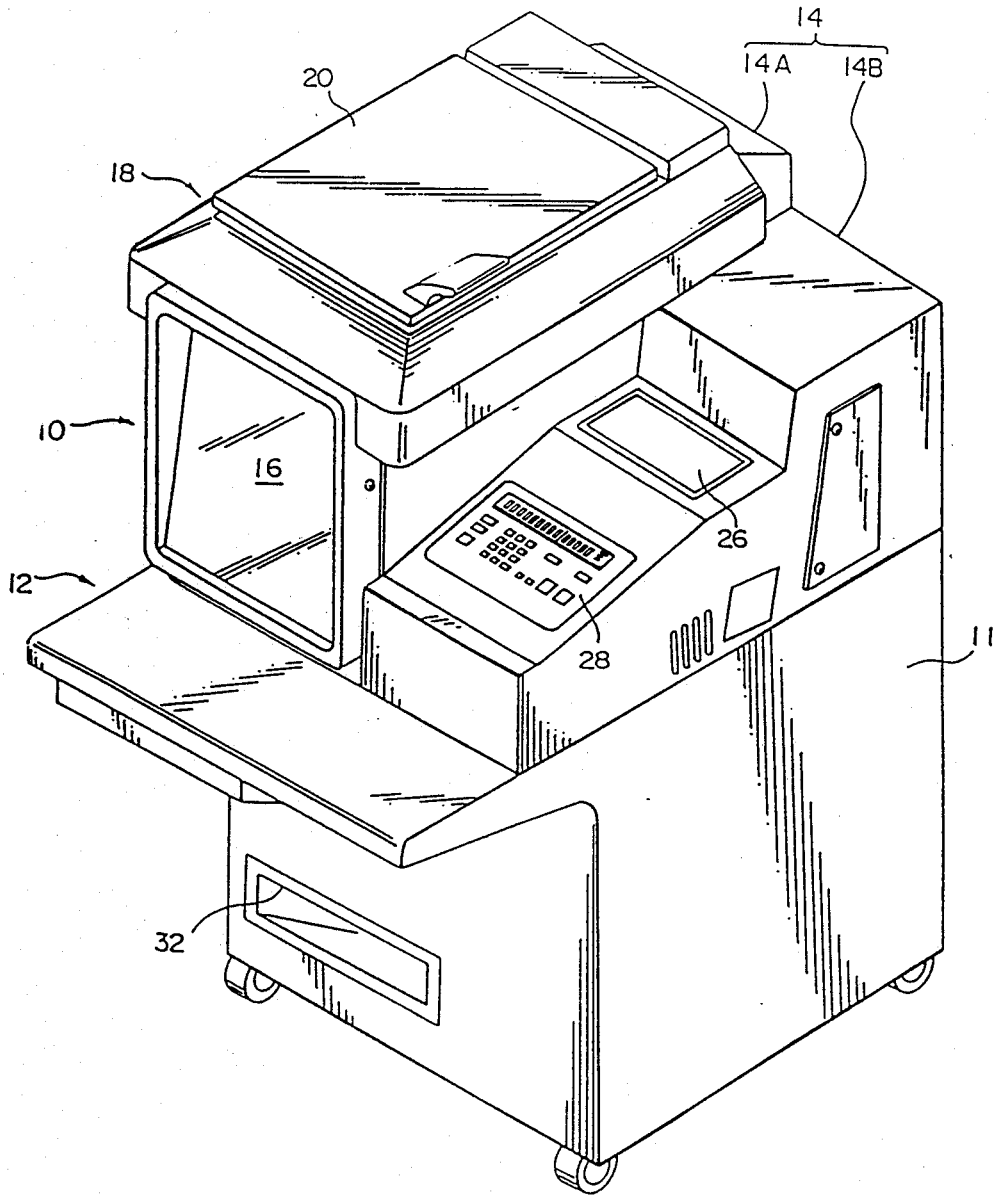
FIG. 1 is a perspective view of an electrophotographic apparatus to which the present invention pertains.

FIG. 1 shows one example of an electrophotographic apparatus having a processing head to which the present invention pertains. The electrophotographic apparatus has various functions: namely, the camera function which enables the image of a document to be recorded on an electrophotographic film; the reader function which enables the image recorded on the film to be enlarged and projected on a screen; and the copy function which enables the image recorded on the film to be enlarged and copied on a sheet of copying paper.

The electrophotographic apparatus has on integral structure which consists of an electrophotographic apparatus body 10, a housing 11, and a copying machine 12 serving also as a table for mounting the body 10. When the copy function is not needed, the electrophotographic apparatus body 10 may be used alone. The apparatus body 10 includes a housing 14 which consists of a left-hand portion 14A having a substantially rectangular paralleleconduitd configuration and a right-hand portion 14B which has a stepped upper surface. The respective internal spaces of these portions 14A and 14B are communicated with each other at the side thereof which is closer to the rear end of the apparatus.

A rear projection screen 16 is disposed in the housing portion 14A in such a manner that the screen 16 closes an opening provided in the front side of the housing portion 14A and it is slightly slanted rearwardly. A document table 18 is disposed on the upper side of the housing portion 14A. The document table 18 includes a document pressing plate 20 which can be opened and closed as desired, and a transparent glass plate 22 (see FIG. 2) which is disposed underneath the plate 20 in such a manner as to close an opening provided in the upper side of the housing portion 14A. A cassette loading section 26 into which a cassette accommodating an electrophotographic microfilm 24 (see FIG. 2; hereinafter referred to as an "electrophotographic film") is loaded is provided in the central portion of the upper side of the housing portion 14B. A control keyboard 28 through which various controls of the electrophotographic apparatus are effected is disposed on the front portion of the upper side of the housing portion 14B.

Figure 4:
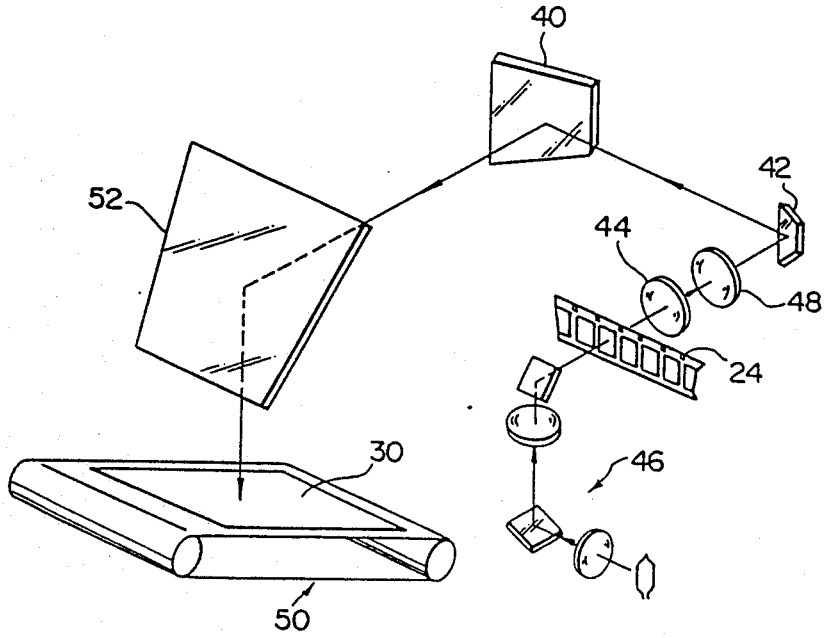
FIG. 4 is perspective view illustrating the concept of a copying optical system in the electrophotographic apparatus.

The housing 11 of the copying machine 12 is provided with an opening 32 for delivering a copied sheet of paper 30 (see FIG. 4).

[Optical Systems of Electrophotographic Apparatus]

Figure 2:
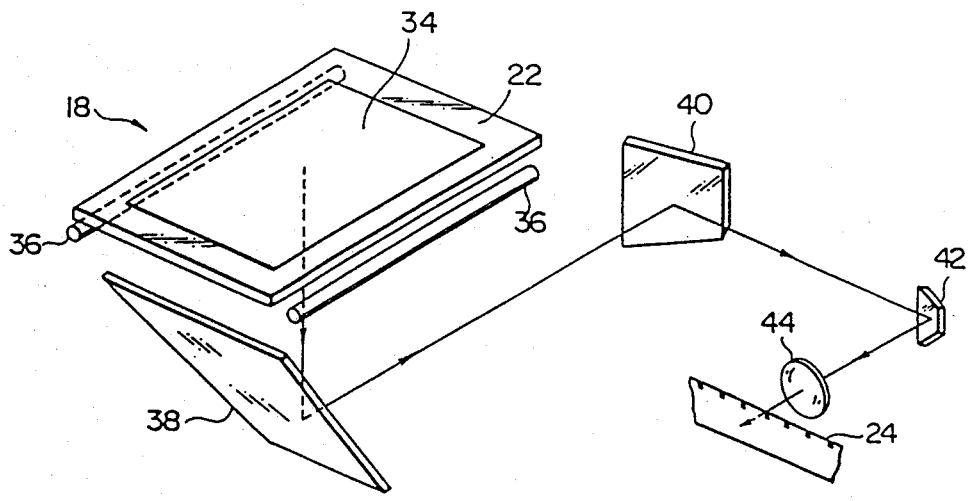
FIG. 2 is a perspective view illustrating the concept of a photographing optical system in the electrophotographic apparatus.
Figure 3:
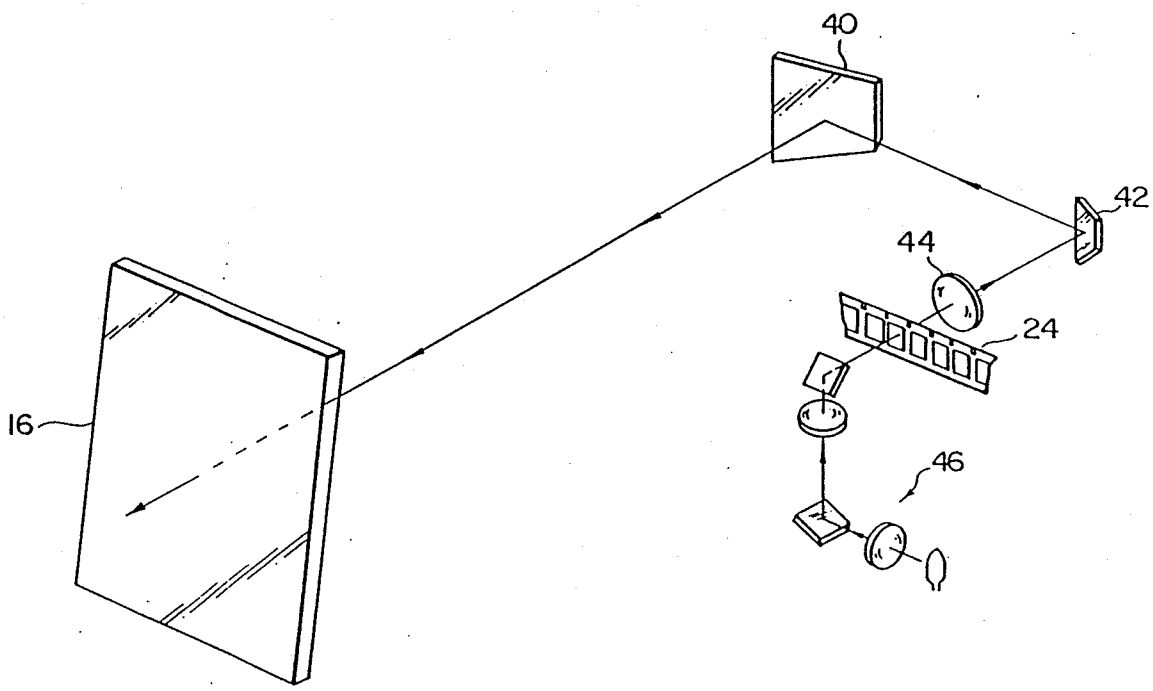
FIG. 3 is a perspective view illustrating the concept of a projecting optical system in the electrophotographic apparatus.

FIGS. 2 to 4 show various optical systems of the electrophotographic apparatus.

Referring first to FIG. 2, the recording optical system includes a document illumination lamp 36 which illuminates a document 34 as a subject which is set on the glass plate 22 of the document table 18 in such a manner that the document surface faces downward, a third mirror 38 on which the light reflected from the document 34 is made incident, a second mirror 40 on which the light reflected from the third mirror 38 is made incident, a first mirror 42 on which the light reflected form the second mirror 40 is made incident, and a main lens 44 for focusing the light reflected form the first mirror 42 on the surface of an electrophotographic film 24.

Referring next to FIG. 3, the projecting optical system includes a projecting light source section 46 for irradiating the electrophotographic film 24, the main lens 44 for focusing the light passing through the film 24 on the first mirror 42, the second mirror 40 on which the light reflected from the first mirror 42 is made incident, and the screen 16 on which the light reflected from the second mirror 40 is projected.

As shown in FIG. 4, the copying optical system includes the projecting light source section 46, the main lens 44, the first mirror 42, the second mirror 40, a conversion lens 48 disposed between the main lens 44 and the first mirror 42 to slightly reduce the optical image formed on the first mirror 42, and a copy mirror 52 adapted to reflect the light reflected from the second mirror 40 toward a sheet of copying paper 30 set on an expsing table 50 disposed in the copying machine 12.

The main lens 44 and the first and second mirrors 42, 40 are mutually used for the above-described three optical system. The main lens 44 and the first mirror 42 are fixedly disposed within the housing portion 14B of the electrophotographic apparatus body 10, while the second mirror 40 is fixedly disposed within the housing portion 14A.

The third mirror 38, the copy mirror 52, the conversion lens 48 and the screen 16 are selectively used. The third mirror 38 and the copy mirror 52 are movably disposed within the housing portion 14A of the apparatus body 10, while the conversion lens 48 is movably disposed within the housing portion 14B so that the lens 48 is prevented from interfering with any other optical system. Since the screen 16 does not interfere with any other optical systems, it is fixedly disposed as described above.

In addition, a shutter (not shown) which is controlled by an automatic exposure controller is disposed between the main lens 44 and the first mirror 42 in the optical systems of the electrophotographic apparatus.

[Processing Head]

FIGS. 5 to 13 show in combination one embodiment of the processing head according to the present invention which is disposed in the above-described electrophotographic apparatus.

Figure 5:
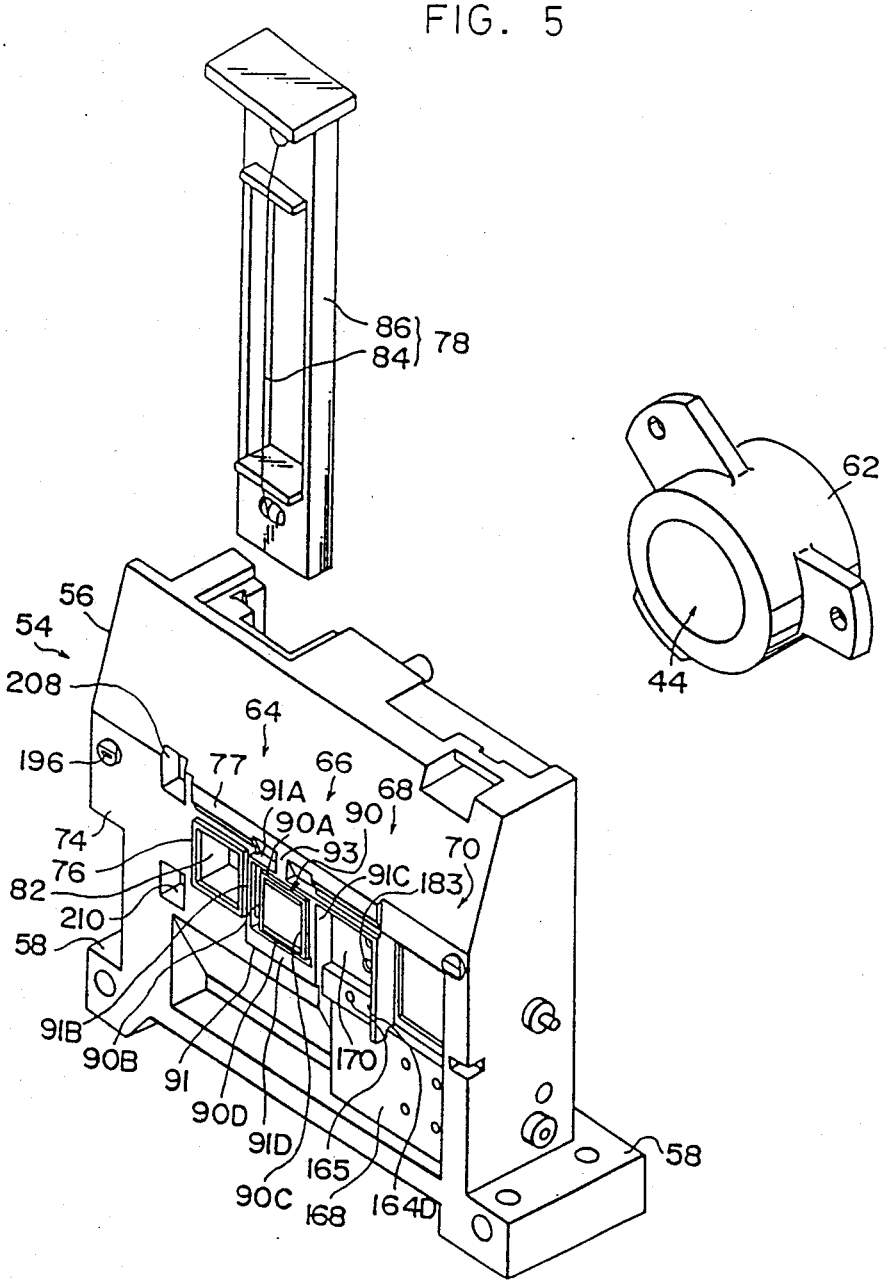
FIG. 5 is an exploded perspective view of a processing head embodying the present invention and incorporated in the electrophotographic apparatus shown in FIG. 1.
Figure 6:
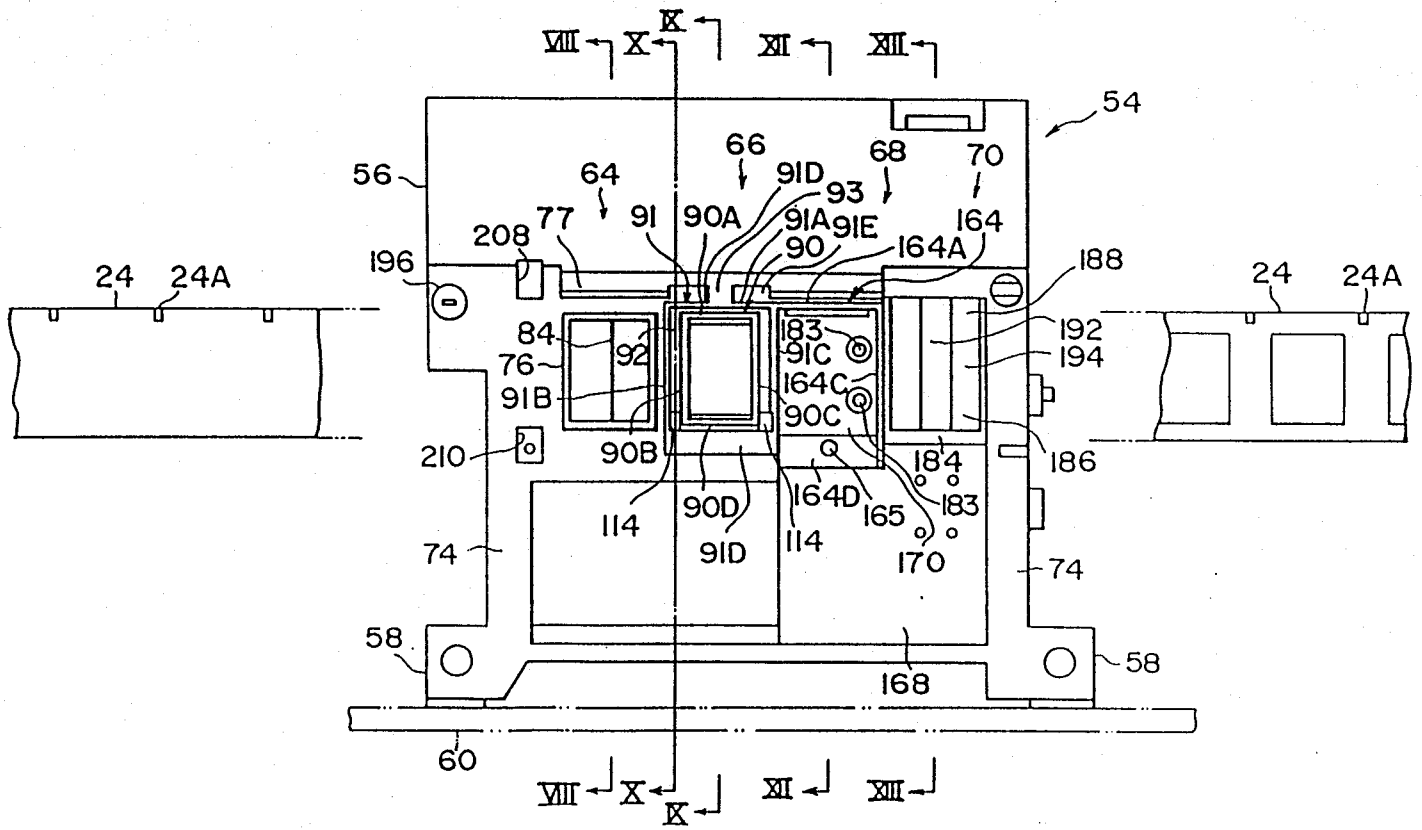
FIG. 6 is a front elevational view of the processing head shown in FIG. 5.

Referring first to FIG. 5 and 6, the processing head 54 had an integral structure which consists of a relatively flat body portion 56 having a substantially rectangular parallelconduitd configuration, and a pair of leg portions 58 located below the body portion 56. The processing head 54 is formed form a synthetic resin by an integral molding process except for fitting members. The processing head 54 is disposed between the main lens 44 and the electrophotographic film 24, which are shown in FIGS. 2 to 4, and the leg portions 58 are secured to a frame 60 disposed within the housing portion 14B of the apparatus body 10, as shown in FIG. 6.

Figure 7:
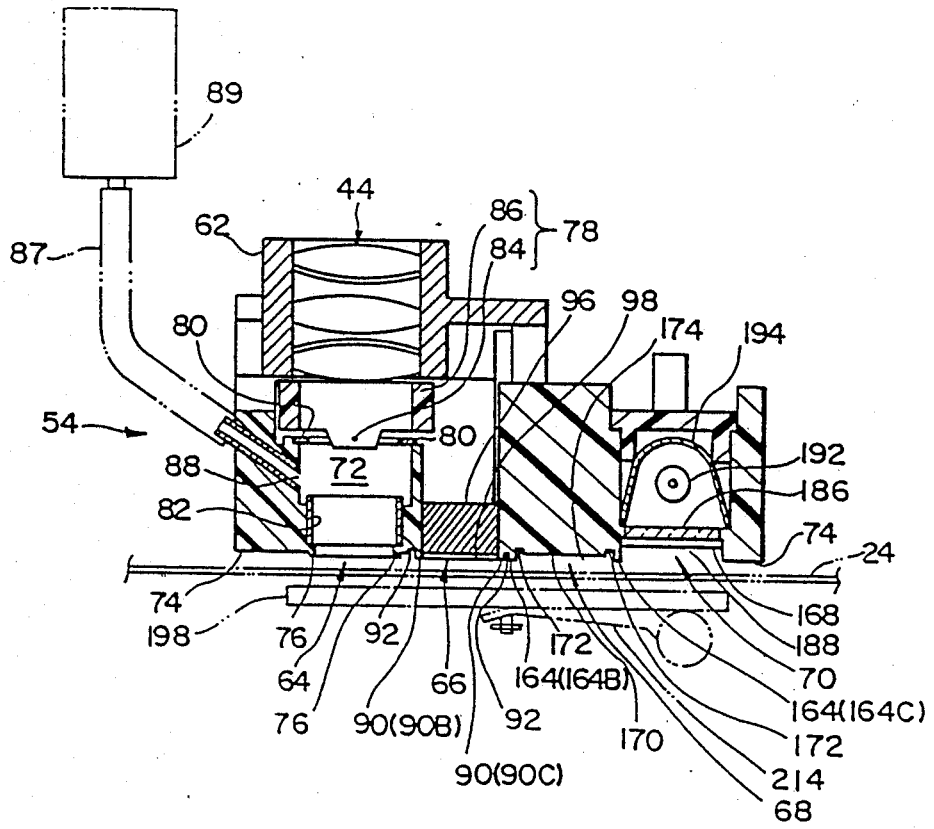
FIG. 7 is a sectional view taken along the line VII-VII in FIG. 6.

The main lens 44 is, as shown in FIGS. 5 and 7, fitted in a lens tube 62 which, in turn, is secured to the rear side of the processing head 54. The electrophotographic film 24 is formed by successively coating a transparent electrically conductive layer, an intermediate layer and a photosensitive layer on a carrier of, e.g., polyethylene. The photosensitive layer consists of a photoconductive layer and a protective layer for protecting the photoconductive layer. This electrophotographic film 24 is formed in the shape of a continuous tape and accommodated in a cassette casing.

Blip marks 24A are printed in advance on the upper edge (as viewed in FIG. 6) of the film 24 at a predetermined regular spacing in the longitudinal direction thereof. Each blip mark 24A is provided in correspondence with one frame for an image which is to be recorded on the film 24. The film 24 is disposed in such a manner that the photosensitive layer side thereof faces the front side of the processing head 54, and is movable in the lateral direction (the horizontal direction as viewed in FIG. 6) of the processing head 54 by driving a film moving motor (not shown). The transparent electrical connection with the apparatus body 10 when the cassette is loaded therein. It is a matter of course that any type of known electrophotographic film may be employed in addition to the film of the type described above.

As shown in FIGS. 5 to 7, a charging/exposure section 64, a developing section 66, a drying section 68 and a fixing section 70 are successively formed in the body portion 56 of the processing head 54 along the lateral direction thereof at a constant pitch which corresponds to the frame pitch of the film 24.

[Charging/Exposure Section]

Figure 8:
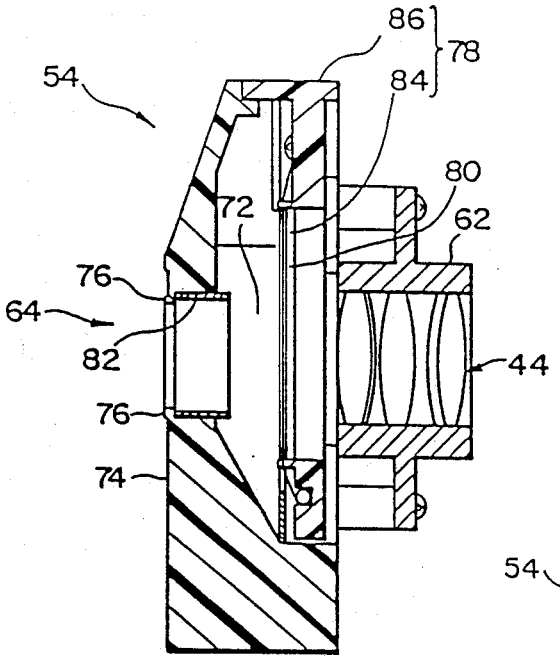
FIG. 8 is a sectional view taken along the line VIII-VIII in FIG. 6.

As shown in FIGS. 7 and 8, the charging exposure section 64 has a charging exposure chamber 72 which is defines by an internal space provided on the reverse side of a front wall 74 of the processing head 54. The chamber 72 is communicated with an opening provided in the front wall 74 of the head 54. As also shown in FIGS. 5 and 6, a mask 76 is formed along the peripheral edge of the opening in the front wall 74, the mask 76 slightly projecting from the surface of the front wall 74. The mask 76 defines a rectangular opening the size of which corresponds to one frame of the film 24. In the charging exposure chamber 72 are disposed a corona unit 78, proximity electrodes 80 and a mask electrode 82.

As shown in FIG. 5, the corona unit 78 consists of a corona wire 84 and a holder 86 made of a synthetic resin and adapted to hold the corona wire 84, the unit 78 being inserted into the processing head 54 from the upper side thereof. The proximity electrodes 80 are respectively defined by relatively narrow metal plates and disposed on both sides of the corona wire 84. The mask electrode 82 is formed by bending a metal plate in a square shape, and disposed in the vicinity of the opening in the front wall 74. The corona wire 84 is connected to a high-voltage power supply, while the proximity electrodes 80 and the mask electrode 82 are electrically connected to each other. In general, the proximity electrodes 80 are connected directly to the ground, while the mask electrode 82 is connected to the ground through an electrical resistance. However, bias voltages which are different from each other may be respectively applied to the proximity and mask electrodes 80 and 82 from an external power supply.

As shown in FIG. 7, a film cooling air inlet 88 is opened into the charging exposure chamber 72 so that cold air is supplied to the chamber 72 with an air pump 89 through a conduit 87. The main lens 44, which is mounted on the rear side of the processing head 54 through the lens tube 62, has the optical axis thereof made coincident with the center of the opening defined by the mask 76.

The charging/exposure section 64 has a transversely-extending guide projection 77. The guide projection 77 has the same height as the mask 76 and is intended for preventing, when the electrophotographic film 24 is set in the cassette loading section 26 together with the cassette, the electrophotographic film 24 from being caught by the mask 76 on the front wall 74 of the main part 56 of the processing head 56. To this end, the surfaces on the upper and lower sides are tapered such as to progressively decrease the height.

[Developing Section]

As shown in FIGS. 5 and 6, the developing section 66 has a mask 90. The mask 90 is defined by an upper frame member 90A, left and right frame members 90B, 90C, and a lower frame member 90D which protrude from the front wall 74. The height or amount of protrusion of the mask 90 is the same as that of the protrusion of the mask 76 in the charging/exposure section. An outer frame 91 also protrude from the front wall 74 so as to surround the frame 91, thus forming a recess 92 between itself and the mask 90. The height or amount of protrusion of the outer frame 91 is the same as that of the mask 90. The recess 92 surrounds the mask 90. As is the case of the mask 90, the outer frame 91 has an upper frame member 91A, left and right frame members 1B, 91C, and the lower frame member 91D. The central portion of the upper frame member 91A is connected through a narrow guide projection 93 to a horizontal guide projection 77 which extends horizontally from an upper portion of the charging/exposure section 64. The width of the recess 92 is greater at the portion between the upper frame members 90A and 91A and at the portion between the lower frame members 90D and 91D than at the portion between the left frame members 90B and 91B and the portion between the right frame members 90C and 91C.

The guide projection 93 plays the same role as the guide projection 77 of the charging/exposure section 64. The lower frame member 91D of the outer frame 91 has a width which is greater than that of other frame members 91A, 91B and 91C of the same. The portion between the guide projection 77 on the upper portion of the developing section 66 and the upper frame member 91A of the outer frame 91 has the form of a groove the depth of which is progressively increased towards the upper frame member 91A.

The width of the opening defined by the mask 90 is set such as to be slightly smaller than that of the opening defined by the mask 76. The height of the opening defined by the mask 90, that is, the distance between the respective inner walls of the upper and lower frame members 90A and 90D, is set such as to be larger than that of the opening defined by the mask 76 since the inner wall of the lower frame member 90D is positioned lower than that of the mask 76.

Figure 9:
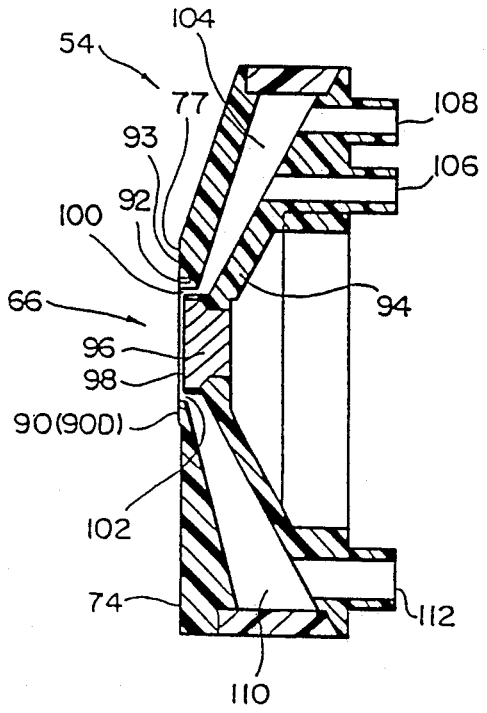
FIG. 9 is a sectional view taken along the line IX—IX in FIG. 6.

As shown in FIG. 9, a developing electrode 96 is disposed within the opening defined by the mask 90, the electrode 96 being supported by a rear wall 94. The developing electrode 96 is connected to a bias power supply. The developing electrode 96 is positioned in such a manner that the outer surface thereof is located at a position which is slightly inner than the end face of the mask 90. The space surrounded by the developing electrode 96 and the inner walls of the mask 90 defines a developing chamber 98. An opening is provided between the upper edge of the electrode 96 and the mask 90 to define a developer and squeezing air inlet 100, and another opening is provided between the lower edge of the electrode 96 and, the mask 90 to define a developer and squeezing air outlet 102.

The surface of the mask 90 of the developing chamber is smoothed so as to exhibit a high draining efficiency.

The developer and squeezing air inlet 100 is communicated with a passage 104 constituted by the internal space of the process head 54. The passage 104 is communicated with a developer supply port 106 and a squeezing air supply port 108, which are provided in the rear side of the processing head 54. The developer and squeezing air outlet 102 is communicated with a passage 110 defined by a space inside the processing head 54. The passage 110 is communicated with a developer and squeezing air discharge port 112 which is provided in the rear side of the processing head 54.

Figure 10:
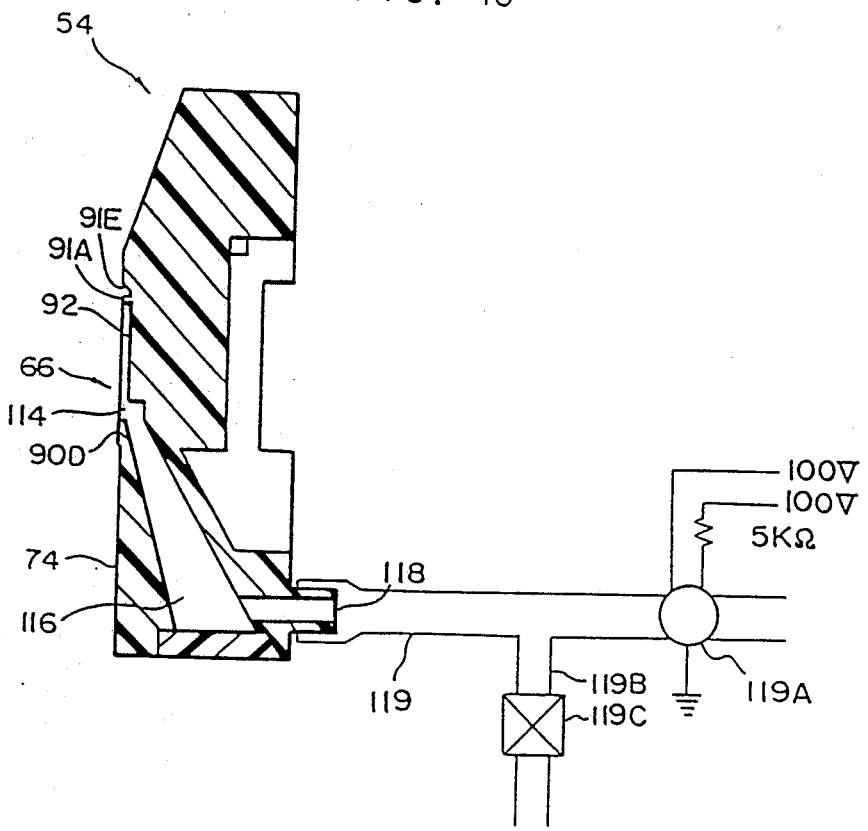
FIG. 10 is a sectional view taken along the line X—X of FIG. 6.

As will be seen from FIG. 10, the portions of the recess 92 located at the corners where the lower frame member 90D intersect the left and right frame members constitute seal pressure supply ports 114.

From FIG. 10, it will be understood that the seal pressure supply ports 114 are communicated with a passage 116 which is constituted by an internal space of a process head 54. The passage 116 in turn communicates with a seal pressure inlet 118 formed in the rear side of the process head 54. The seal pressure supply port 118 is connected to a pump 119A through a conduit 119. A power supply to the pump 119A is switchable between two mode: namely, a first mode in which it directly supplies 100V power and a second mode in which it supplies 100V power through a resistor of 5 K Ohms, whereby the pressure of the seal air to the seal air inlet is switchable in two stages. More specifically, the pump 119A and associated parts are so designed that the seal H air has a pressure of 200 mm $H_20$ in the low pressure mode and 500 mm$H_20$ or higher in high pressure mode.

Figure 16:
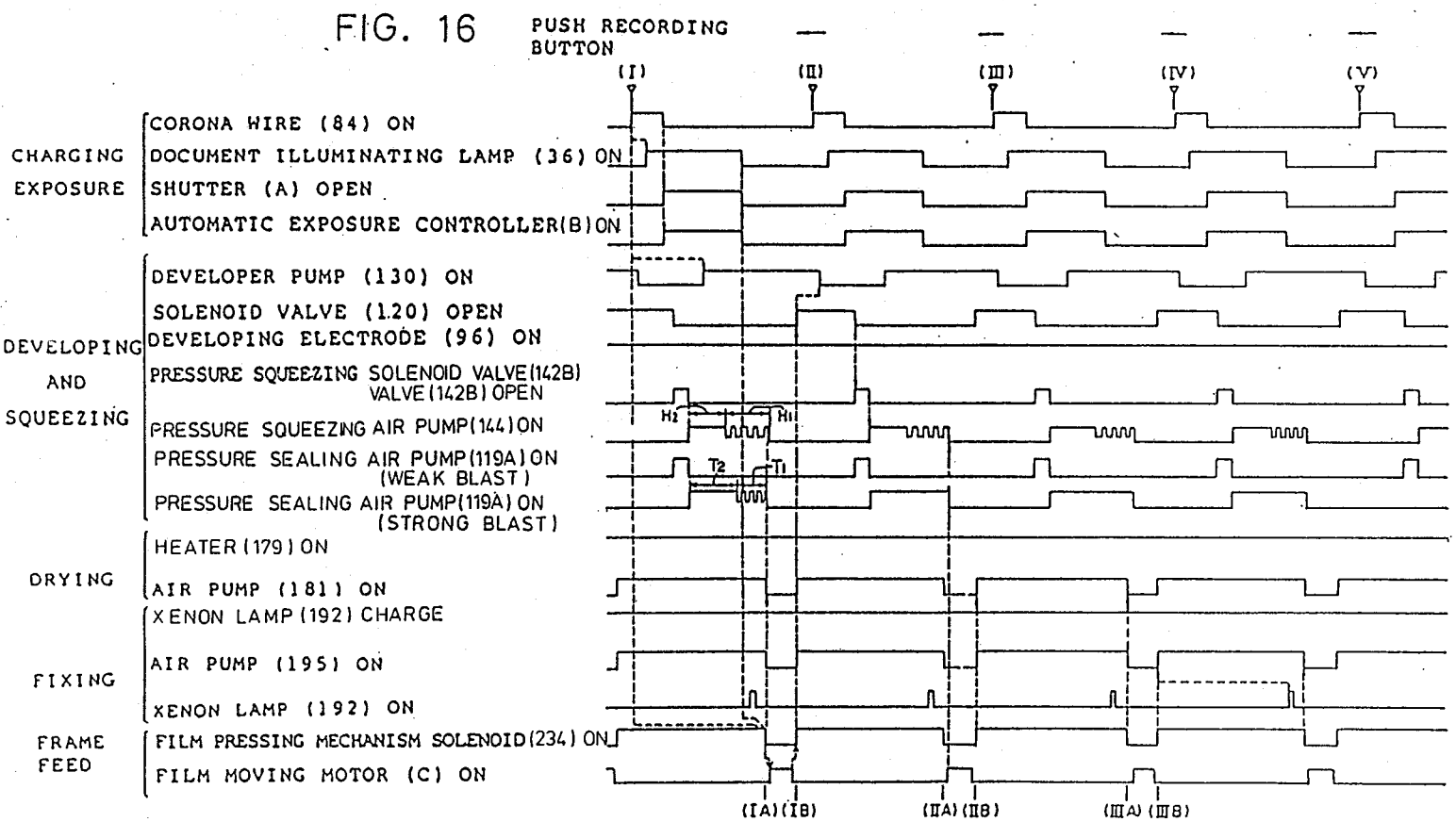
FIG. 16 is a time chart showing the operation of the electrophotographic apparatus in camera mode.

When the seal air is supplied in high-pressure mode, the seal pressure is preferably changed cyclically with a period $T_1$ as shown in FIG. 16. This cyclic change in the seal air pressure may be conducted within the range between 800 and 1500 mm$H_20$. It is possible to arrange such that the period of supply of air in low pressure mode is 0.05 second while the period of seal air supply in high pressure mode is 0.25 second. This cyclic change of the seal air pressure may be commenced when a time $T_2$ has elapsed after the start of the seal air supply in high pressure mode. This period $T_2$ is, for example, 0.5 second. The total period ($T_1+T_2$) may be 1.5 second.

The conduit 119 has an intermediate branch 119B which connects to a solenoid valve 119C. This solenoid valve 119C is so designed as to cyclically open and close thereby causing the above-mentioned cyclic change in the seal air pressure in the high pressure mode. More specifically, when the solenoid valve 119C is opened, the conduit 119 is opened to the atmosphere so that the seal air pressure in the high pressure mode is reduced to cause the above-mentioned cyclic change in the seal air pressure.

The cyclic change in the seal air pressure in the high pressure mode need not be repeated: namely, the change in the seal air pressure may be conducted only once.

Figure 11:
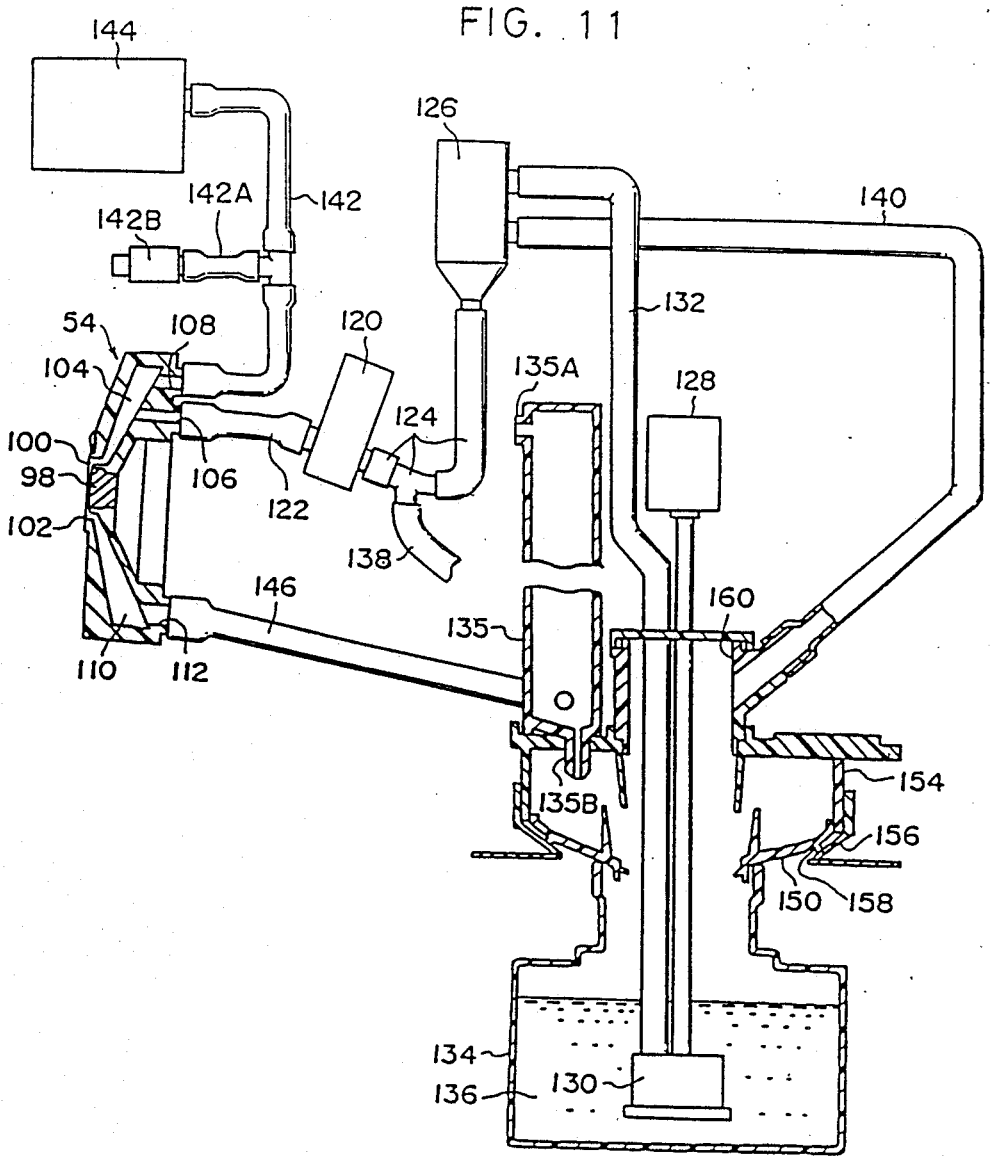
FIG. 11 is an illustration of a developing section in the processing head in relation to other devices.

Referring now to FIG. 11, the developer supply port 106 is connected to a developer tank 126 through conduits 122 and 124 past the solenoid valve 120. The developer tank 126 is set at a level above the level of the solenoid valve 120. A developer pump 130 driven by a motor 128 is connected to the developer tank 126 through a conduit 132. The developer pump 130 is disposed in a developer bottle 134 which contains a developer 136 composed of toner particles dispersed in a solvent.

The conduit 124 between the solenoid valve 120 and the developer 126 has a branch which constitutes a return conduit 138 opening in the developer bottle 134. A return conduit 140 which opens in the developer bottle 134 is connected to the developer tank 126.

The squeezing air supply port 108 is connected to a pressurizing squeezing air pump 144 through a conduit 142 so that it supplies squeezing air pumped by the air pump 144. The conduit 142 is provided at its intermediate portion with a branch 142A having a solenoid valve 142B so as to be selectively opened to the atmosphere through the solenoid valve 142B. Namely, the pressure in the passage 104 is reduced to the same level as the atmospheric air as the solenoid valve 142B opens, so that the developer in the developing chamber 98 naturally flows down so as to attain a pre-squeezing condition. The period of opening of the pressurized squeezing air solenoid valve 142B andthe period of operation of the pressurized squeezing air pump 144 are so selected as to be equal to the periods of supply of the pressurized air from the pressurized seal air pump 119A in low and high pressure modes, respectively.

In the described embodiment, the pressure of the squeezing air can be changed cyclically throughout a predetermined time $H_1$.

Preferably, the cyclic change in the supply pressure is conducted when a predetermined time $H_2$ has elapsed after the commencement of supply of the squeezing air in high pressure mode. Practically, the time $H_2$ has a suitable length longer than 0.5 second, and the period of cyclic change in the pressure is practically between 0.05 and 0.5 second. In order to attain an appreciable effect, it is desirable that the amplitude of the pressure change is at least 100 mm$H_2O$. The period of supply of the air in low-pressure mode is preferably about 0.5 second, while the period of supply of the air in high-pressure mode is preferably 1.5 second or so. The difference in the air pressure between the low-pressure mode and the high-pressure mode is preferably 200 to 400 mm$H_2O$.

The change in the air pressure, however, need not always be cyclic. Namely, the change in the air pressure is effected at least once.

Preferably, the cyclic change in the pressurized squeezing air is conducted in an inverted phase relation to the cyclic change in the pressurized sealing air. That is, the cyclic changes in the squeezing air and the sealing air are conducted in synchronism in such a manner that the seal air pressure of high level is produced when the squeezing air pressure is low, and the seal air pressure of low level is produced when the level of the squeezing air is high.

A return conduit 146, which is connected to the aforementioned developer and squeezing air outlet 112, opens in a gas-liquid separator 135 attached to the developer bottle 134. A frusto-conical saucer 150 is mounted on the developer bottle 134. The lower end of the saucer 150 slightly projects inwardly of the developer bottle 134 and the underside of the saucer 150 hermetically contacts the upper end of the developer bottle 134 so as to close the developer bottle 134. The arrangement is such that, when the motor 128 is lifted, the developer pump 130 also is raised so that a lower flange on the pump 130 engages with the brim of the saucer 150, whereby the saucer 150 is withdrawn together with the pump 130, thereby allowing the developer bottle 134 to be replaced.

During the upward movement, the saucer 150 slides along the inner peripheral surface of a cylindrical member 154 which is suspended vertically from a supporting plate 152. The saucer member 150 has a downward annular projection 158 which resiliently engages with a tapered resilient sheet 156 attached to the cylindrical member 154 thereby sealing the interior of the developer bottle 134 from the ambient air.

Another cylindrical member 160 is fixed to the supporting plate 152. The return conduit 140 is communicated with the interior of this cylindrical member 160. The aforementioned gas-liquid separator 135, which is located adjacent to the cylindrical member 160 is provided with a communication port 135A formed in a portion of the side wall near the top end thereof and communicating with the ambient air. A discharge conduit 135B projects downward from the bottom of the gas-liquid separator 135 through a hole formed in the supporting plate 152 so as to return only the liquid content into the developing bottle 134.

In FIG. 11, the process head 54 is illustrated at a slight inclination. This is because the process head 54 is inclined in such a manner as to set the optical axis of the optical system perpendicularly to the screen 16 which is installed at an inclination.

[Drying Section]

As shown in FIGS. 5 and 6, the drying section 68 has a frame wall 164. The frame wall 164 is composed of an upper frame member 164A which is a horizontal extension of the upper frame member 91A of the developing section 66 and a right frame member 164C which depends from the end of the upper frame member 164A so as to oppose the right frame member 90D of the developing section 66. The upper frame member 164A and the right frame member 164C have the same height as the outer frame 91 and the mask 90 in the developing section 66. The frame wall 164 further has a lower frame member 164D disposed between the right frame member 164C of the drying section 68 and the right frame member 90C of the developing section 66 and having a projection height smaller than that of these frame members. A hole 165 for mounting a heater is formed in this lower frame member 164D.

A drying region 174 in the drying section 68 is defined by the upper frame member 164A, right frame member 164C and the lower frame member 164D of the drying section 68 and also by the right frame member 91C of the developing section 66. The bottom surface 170 of the drying region 174 thus defined is of the same projection height as the front wall 168 which is recessed from the front wall 74 under the drying section 68 and the fixing section 70.

The size of the region inside the frame wall 164 is greater than that of the developing mask 90. A guide projection 77, which is extended through a region above the developing section 66, is positioned above the upper frame member 164A. This guide projection 77 has the same role as the guide projection 77 of the charging/exposure section 64 and the guide projection 93 of the developing section 66. The span of the region inside the frame wall 164, i.e., the distance between the right frame member 164C of the drying section 68 and the right frame member 91C of the developing section 66, is greater than the width of opening of the mask 90. The lower surface of the upper frame member 164A, i.e., the surface facing the drying region, is positioned at a level above that of the mask 90 of the developing section 66.

Figure 12:
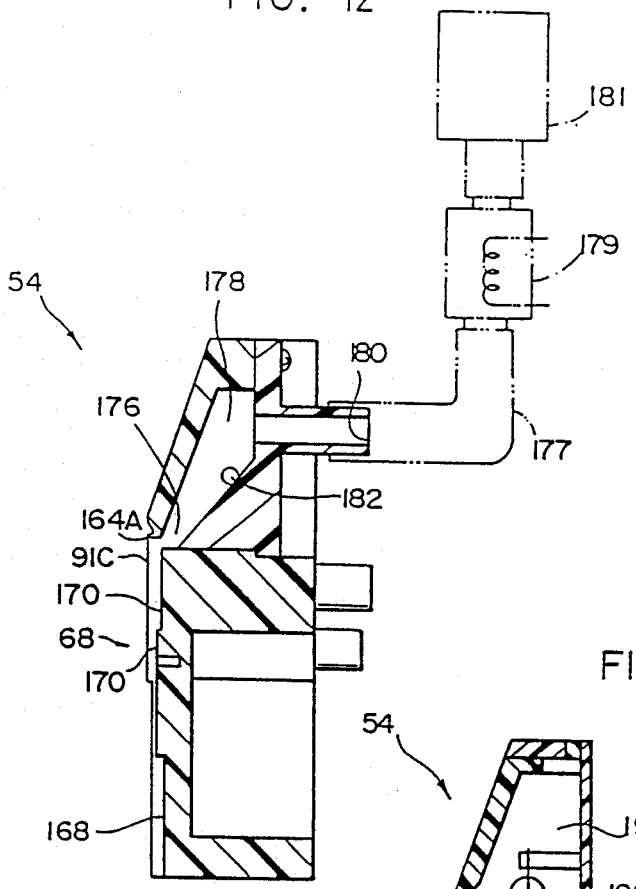
FIG. 12 is a sectional view taken along the line XII—XII of FIG. 6.

As will be seen from FIGS. 6 and 12, the lower portion of the upper frame member 164A is slit so as to constitute a heated air outlet 176. The heated air outlet 176, as will be seen from FIG. 12, communicates with a passage 178 which is constituted by the space inside the process head 54. The passage 178 communicates with a heated air supply port 180 which opens in the rear wall of the process head 54. A temperature sensor 182 is disposed in the passage 178. An air pump 181 is connected to the heated air supply port 180 through a conduit 177 having a heater 179 so that heated air is supplied into the passage 178.

The bottom wall 170 of the drying section has a pair of circular holes 180 which serves as leader holes for electric wiring to the heater which may be attached to the bottom wall 170.

[Fixing Section]

The fixing section 70 is, as shown in FIGS. 5 to 7, defined between the right frame member 164C of the frame 164 and the right-hand end portion of the front wall 74. The fixing section 70 has a frame 184 which consists of a lower frame member and left and right frame members, the frame 184 being located at a position which is further depressed from the recess 168 in the front wall 74. A transparent glass plate 186 is fitted in the frame 184. The space provided on the front side of the glass plate 186 defines a fixing chamber 188.

Figure 13:
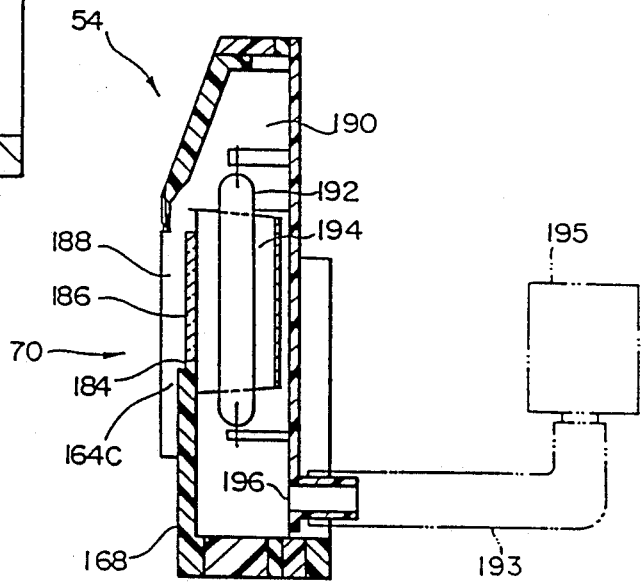
FIG. 13 is a sectional view taken along the line XIII-XIII of FIG. 6.

As shown in FIG. 13, a xenon lamp 192 and a reflecting plate 194 are disposed within a space 190 inside the processing head 54 which is provided on the reverse side of the glass plate 186. A cooling air inlet 196 opens into the space 190 so that cold air is supplied to the space 190 from an air pump 195 through a pope 193. The space 190 and the fixing chamber 188 are communicated with each other through the area defined at the upper edge of the glass plate 186.

[Blip Sensor]

Referring to FIGS. 5 and 6, the processing head 54 has a blip sensor 196 which is disposed on the left-hand end portion of the front wall 74. The blip sensor 196 is located at a position at which the blip marks 24A printed on the electrophotographic film 24 pass, the film 24 being moved along the front side of the processing head 54. Thus, when each blip mark 24A passes, the blip sensor 196 detects interception of the light from a light source for the sensor 196 which is disposed in opposing relation to the sensor 196 across the film 24.

[Film Pressing Mechanism]

Figure 14:
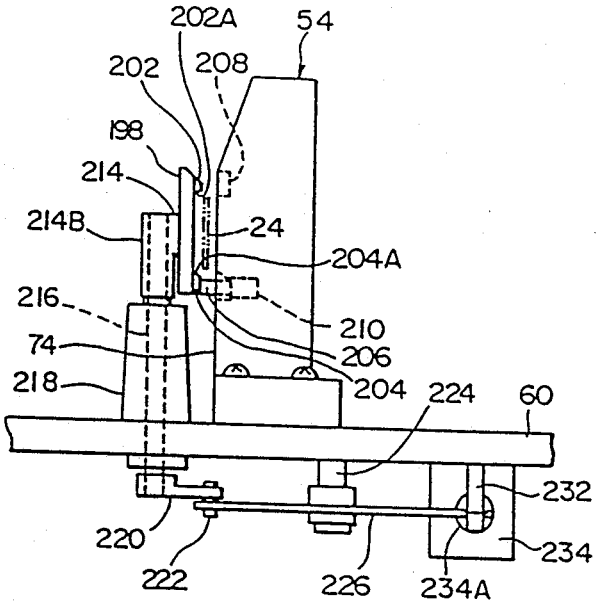
FIG. 14 is a schematic side elevational view of an essential portion of the present invention, illustrating the positional relationship between the processing head and a pressing plate.

As shown in FIGS. 7 and 14, a pressing plate 198 serving as the film pressing means is disposed in front of the front wall 74 of the processing head 54. The pressing plate 198 is, as shown is FIG. 15, provided with a rectangular through-hole 200 which is a size smaller than the opening defined by the mask 76 formed in the charging exposure section 64. The pressing plate 198 is disposed in such a manner that the through-hole 200 opposes the mask 76.

Figure 15A:
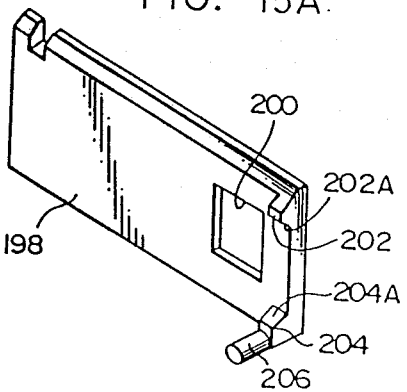
FIG. 15A is a perspective view of a portion of the film pressing mechanism as seen from the opposite side to FIG. 15.
Figure 15:
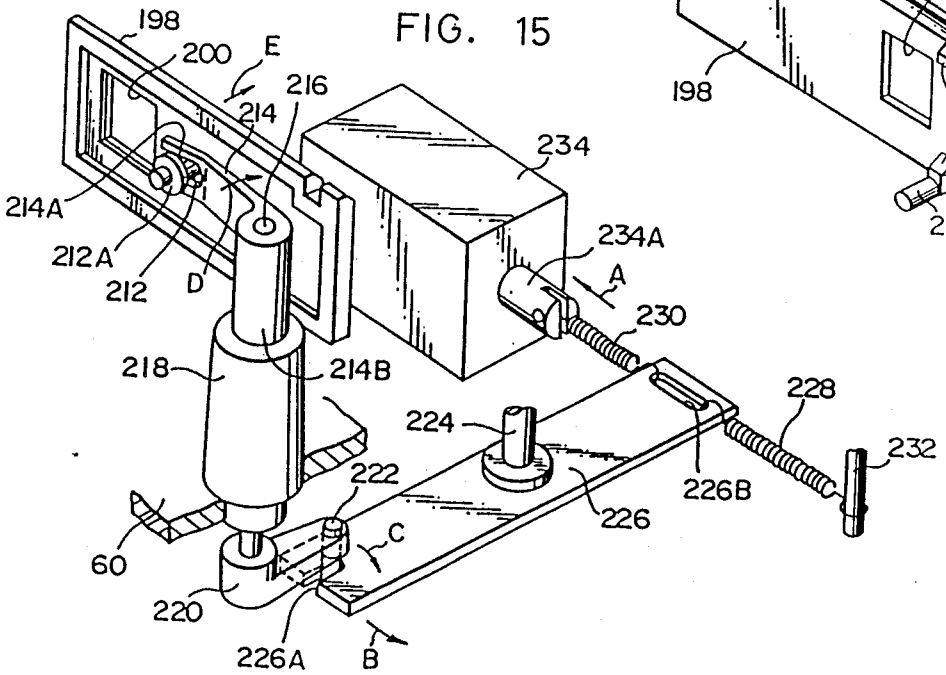
FIG. 15 is a perspective view of a film pressing mechanism provided on the processing head.

As will be seen from FIG. 15A which is a perspective view as viewed in the direction opposite to FIG. 15, the pressing plate 198 have claws 202, 204 which are formed at an upper portion and a lower portion thereof near the end having the through-hole 200, such as to project towards the process head 54. The opposing surfaces of these claws 202 and 204 are slanted as at 202A and 204A. As will be understood from FIG. 14, the distance between upper and lower claws 202, 204 as measured at base portions of these claws is substantially the same as, more precisely slightly greater than, the width of the electrophotographic film 24. A columnar portion 206 is formed on the claw 204 so as to project therefrom. These claws 202 and 204 are adapted to be received in holes 208 and 210 which are formed in the front wall 74 of the process head 54.

The pressing plate 198 has a columnar portion 212 projecting from the reverse surface thereof, that is, the surface thereof which is remote from the processing head 54. This columnar portion 212 is engaged with a notched portion 214A formed at one end portion of an arm 214. A stop ring 212A is rigidly secured to the distal end portion of the columnar portion 212 so as to prevent the notched portion 214A from coming off the columnar portion 212. A boss portion 214B is formed at the other end of the arm 214. A shaft 216 is rigidly secured to the boss portion 214B.

The shaft 216 is rotatably fitted into and thereby supported by a stand 218 projecting from the frame 60 to which the processing head 54 is secured, the lower end portion of the shaft 216 projecting from the reverse surface of the frame 60. A first lever 220 is rigidly secured to the projecting lower end portion of the shaft 216. A pin 222 is rigidly secured to the distal end portion of the first lever 220.

A shaft 224 is suspended from the reverse side of the frame 60. The shaft 224 pivotally supports the intermediate portion of a second lever 226. A notched portion 226A is formed at one end of the second lever 226, and the pin 222 is engaged with the notched portion 226A. A slot 226B is formed in the other end portion of the second lever 226, and one end portion of each of the tension coil springs 228 and 230 is retained by the slot 226B, the springs 228 and 230 biasing the second lever 226 in the opposite directions to each other so as to support the lever 226 resiliently.

The other end portion of the tension coil spring 228 is retained by a pin 232 suspended from the reverse side of the frame 60, while the other end portion of the tension coil spring 230 is retained by a plunger 234A of a pull-type solenoid 234 which is secured to the reverse side of the frame 60.

When the solenoid 234 is not energized, the pressing plate 198 is separated from the processing head 54. In this state, the pressing plate 198 is supported in such a manner that the columnar portion 206 is fitted into the bore 210 as shown in FIG. 14.

When the solenoid 234 is energized, the plunger 234A is activated to move in the direction of the arrow A, causing the tension coil springs 228 and 230 to be expanded against the biasing forces. In consequence, the second lever 226 is pivoted about the shaft 224 in the direction of the arrow B, so that the first lever 220 is pivoted about the pin 222 in the direction of the arrow C, thus causing the shaft 216 to turn in the same direction. Thus, the arm 214 is pivoted in the direction of the arrow D so to press the pressing plate 98 in the direction of the arrow E.

Therefore, the pressing plate 198 is made to move in the direction of the arrow E with the columnar portion 206 guided by the hole 210, thereby urging the electrophotographic film into contact with the masks 76, 90 and the end surface of the frame wall 164. Any heightwise misalignment of the electrophotographic film 24 is corrected during this movement of the pressing plate 198 because the slanted surfaces 202A and 204A of the claws 202 and 204 serve as guides which are capable of urging the upper edge and the lower edge of the film 24 downward and upward, respectively.

The pressing plate 198, when keeping the electrophotographic film in contact with the process head 54, is correctly located with respect to the process head 54 because the claws 202 and 204 are received in the holes 208 and 210. In this state, the pressing plate 198 is resiliently urged by the coiled springs 228, 230 so as to press the electrophotographic film in a resilient manner.

As the solenoid 234 is de-energized,the second lever 226 is pivoted in the direction counter to the direction of the arrow B by the force of the tensile spring 228, so that the arm 214 is rotated in the direction counter to the direction of the arrow D. In consequence, the notched portion 214A presses the stop ring 212A, causing the pressing plate 198 to move counter to the direction of the arrow E.

[Operation]

The following is a description of the operation of this embodiment.

The electrophotographic apparatus is arranged such that, when the power supply switch is turned ON, the cassette loading section 26 (shown in FIG. 1) is raised, thereby allowing a cassette accommodating the electrophotographic film 24 to be loaded into the section 26. After the cassette has been loaded into the cassette loading section 26, the operator pushes down the section 26 to the initial position by a manual operation. In consequence, the cassette loading section 26,is locked at said position. In this state, the film 24 is positioned as shown in FIG. 14 and is allowed to move along the front side of the processing head 54 by the operation of a film moving motor (not shown).

When the image of the document 34 (shown in FIG. 2) is to be recorded on the film 24, the film moving motor is activated to move the film 24 in such a manner that a given frame which is selected from the unexposed frames as desired is positioned in from of the mask 76 in the charging exposure section 64. This operation is executed by designating a desired frame through the control keyboard 28 shown in FIG. 1. The positioning of the selected frame with respect to the charging exposure section 64 is effected by virtue of the blip sensor 196 which counts the number of blip marks 24A from a reference point.

FIG. 16 is a time chart showing the operation of the apparatus in the case where a given frame is positioned as described above and subjected to recording and, subsequently, continuous recording is effected on each of the frames which consecutively follow the first recorded frame. In the processing head 54, when the frame positioned at the charging exposure section 64 is being subjected to charging and exposure operations, frames which are respectively positioned at the developing section 66, the drying section 68 and the fixing section 70 are simultaneously subjected to different kinds of processing, respectively. However, the following description will be made about only one frame which is to be subjected to recording when the recording button is pressed at the position (I) in FIG. 16 to start recording.

Recording of the document 34 is made possible by selecting the camera mode through the control keyboard 28. Simultaneously with this mode selecting operation, a bias voltage is applied to the developing electrode 96 in the developing section 66, the heater 179 for heating air sent to the drying chamber 174 is energized so as to generate heat, and a capacitor for the xenon lamp 192 in the fixing section 70 is supplied with current so as to be charged. These operations are continued while the camera mode is being selected.

When the recording button on the control keyboard 28 is pressed, a high voltage is applied to the corona wire 84 in the charging exposure section 64, causing a corona discharge to occur between the corona wire 84 on one hand and the proximity and mask electrodes 80 and 82 on the other. Thus, the surface of the photosensitive layer of a portion of the film 24 which is positioned within the opening defined by the mask 76 is charged positive.

At the time when the recording button is pressed, the solenoid 234 in the film pressing mechanism has continuously been excited from the previous step. Therefore, the film 24 is pressed by the pressing plate 198 so be in pressure contact with the respective end faces of the masks 76, 90 and the frame 164 of the processing head 54. The pressing plate 198 has the through-hole 200 formed in a portion thereof which opposes the mask 76, but this through-hole 200 is smaller than the opening defined by the mask 76. Therefore, a portion of the film 24 which is positioned at the end face of the mask 76 is pressed by the surface of a portion of the pressing plate 198 around the through-hole 200. Accordingly, the film 24 is reliably brought into close contact with the end face of the mask 76, and the charging range is thereby accurately limited within the opening in the mask 76.

Since the mask electrode 82 provided in the charging-/exposure chamber 72 is maintained at a potential substantially equal to the potential of the charged film 24, the peripheral edge portion of a frame of the film 24 which is positioned at the opening in the mask 76 is also charged at a value close to the potential at the central portion of said frame, thus enabling the whole of a frame of the film 24 to be uniformly charged. The mask electrode 82 can be maintained at a potential substantially equal to the potential of the charged film 24 by appropriately selecting the value of a resistor (not shown) electrically connected between the ground and the mask electrode 82, or by applying a bias voltage to the mask electrode 82 from an external power supply (not shown).

The document illuminating lamp 36 is turned ON when a predetermined period of time has elapsed after the recording button has been pressed at the position (I) in FIG. 16, so as to illuminate the document 34 placed on the glass plate 22 of the document table 18. Further, when a predetermined period of time has elapsed after the recording button has been pressed, the supply of current to the corona wire 84 is suspended, thus completing the corona discharge operation.

At the same time as the suspension of the energization of the corona wire 84, a shutter (not shown but indicated by the reference symbol A in FIG. 16) is opened, and the light reflected from the document 34 placed on the document table 18 is applied to the film 24 by the optical system shown in FIG. 2. In addition, the automatic exposure controller (not shown but indicated by the reference symbol B in FIG. 16) simultaneously starts integration of the quantity of light.

On the other hand, when a predetermined period of time has elapsed after the recording button has been pressed, the motor 128 shown in FIG. 11 (A) is activated to start the operation of the developer pump 130, whereby the developer 136 in the developer bottle 134 is pumped up into the developer tank 126. The developer 136 thus pumped falls from the developer tank 126 by the force of gravity towards the processing head 54 through the conduit 124. In this state, however, the solenoid valve 120 is still kept closed so that the developer 136 is returned to the developer bottle 134 via the return conduit 138. When the level of the developer 136 in the developer tank 126 is raised to a predetermined limit, the developer 136 is returned to the developer bottle 134 through the return conduit 140.

Thus, the developer 136 is circulated between the developer bottle 134 and the developer tank 126 and is stopped at the upstream side of the solenoid valve 120 until the solenoid valve 120 is opened. This recirculation produces an appreciable stirring effect on the developer 36 in the developer bottle 134.

When the integrated value of the quantity of light reaches a set value, the integration effected by the automatic exposure controller (B) is suspended and, at the same time, the shutter (A) is closed, and the document illuminating lamp 36 is turned OFF. At this point of time, the exposure step is completed and, one frame of the film 24 in a portion thereof which is positioned at the opening defined by the mask 76 has an elcctrostatic latent image formed thereon owing to the fact that the electric charge on the photosensitive layer is reduced in accordance with the image pattern on the document 34. Since factors in changes of the image density, such as variations in the ground density of the document 34 and variations in the voltage applied to the document illuminating lamp 36, are corrected by the automatic exposure controller (B), an optimal exposure operation is effected at all times. When a predetermined period of time has elapsed after the recording button had been pressed and all the steps of processing other frames have already been completed, the solenoid 234 of the film pressing mechanism is immediately de-energized. When the solenoid 234 is de-energized at the position (IA) in FIG. 16, the pressing plate 198 is separated form the film 24.

When a predetermined period of time has elapsed after de-energization of the solenoid 234 of the film pressing mechanism, the film moving motor (not shown but indicated at C in FIG. 16) is started so as to effect a one-frame feed of the photographic film 24 rightward as viewed in FIG. 6. In consequence, the frame which has been positioned in the charging/exposure section 64 is moved to the developing section 66. The feed of the electrophotographic film 24 is controlled in accordance with the signal from the blip sensor 196 capable of sensing the blip mark 24A so that the amount of feed precisely coincides with the pitch of the frame, as explained before.

When a predetermined time has elapsed after the stop of the film moving motor C, the solenoid 234 of the film pressing mechanism is energized at a moment (IB) in FIG. 16, thereby causing the pressing plate 198 to press the electrophotographic film 24 onto the processing head 54. At the same time, suction through the suction squeeze opening 118 is commenced and the solenoid valve 120 is opened.

When the solenoid valve 120 is opened, the developer 136 is allowed to reach the processing head 54 through the conduit 122, and the developer 136 then flows into the developing chamber 98 from the developer and squeezing air inlet 100 in the developing section 66. Since the toner particles dispersed in the developer 136 are charged negative, the toner particles, when flowing down through the developing chamber 98, adhere to portions of the film 24 which are charged positive, thereby developing the electrostatic latent image. The developer 136 having flowed down through the developing chamber 98 is returned to the developer bottle 134 from the developer and squeezing air outlet 102 through the return conduit 146.

The diameters of the conduits and other parameters of the developer supply system are so determined that the developer supplied from the developer tank 126 to the conduit 124 is partially returned to the developer bottle 134 through the return conduit 138, while the remainder part of the developer is directed to the solenoid valve 120.

Since the electrophotographic film 24 is pressed by the pressing plate 198 onto the end surface of the mask 90, there is no risk for the developer 136 flowing down through the developing chamber 98 to come into the gap between the end surface of the mask 90 and the electrophotographic film 24.

When a predetermined time has passes after energization of the solenoid 234 of the film pressing mechanism, the motor 128 is stopped to stop the operation of the developer pump 130. The solenoid valve 120, however, is kept opened even after the operation of the pump 130 is stopped. The developer 136 is supplied from the developer tank 126 into the process head 54 by the force of gravity. Therefore, the supply of the developer 136 into the developing chamber 98 is continued even after the stop of the developer pump 130. Therefore, the exposure of the next frame can be conducted with minimum risk of movement which may be caused by the vibration of the developer pump 130. In order to eliminate any unevenness in the tone of the developed image due to movement of the developer in the developing chamber, it is possible to employ a still development in which the development is conducted while the developer is in still state. This can be realized by operating the solenoid valve so as to close the passage of the developer thereby to make the developer still.

When a predetermined opening period has elapsed, the solenoid valve 120 is closed so that the supply of the developer to the developing chamber is ceased. At the same time, the solenoid valve 142B for the pressurized squeezing air is opened thereby allowing the atmospheric air to be supplied into the developing chamber 98 through the squeezing air inlet 100 so as to remove any excessive developer 136 attaching to the surface of the electrophotographic film 24.

The pressurized seal air pump 119A is then started so as to supply the pressurized seal air into the recess 92 around the developing section in the low-pressure mode. This prevents any risk for the developer to come into the sealing recess 92 beyond the mask 90. The removed developer 136 is returned to the developer bottle 134 from the developer and squeezing air outlet 102 via the return conduit 146.

Since in this state the sealing air pressure is comparatively low, there is no risk for the developer on the exposed area of the electrophotographic film 24 to come off.

Then, the solenoid valve 142B is closed and the pressurized squeezing air pump 144 starts to operate so as to supply pressurized air into the developing section and the pressurized seal air pump 119A also starts to operate thereby to supply seal air to the sealing recess 92 in high-pressure mode. The pressure of the squeezing air supplied by the pressurized squeezing air pump 144 is lower than 500 $mmH_2O$, while the pressure of the sealing air supplied by the pressurized seal air pump 119A is higher than 500 $mmH_2O$, so that the pressurized seal air leaks into the developing section 66 from the sealing recess beyond the mask 90. In consequence, the developer attaching to the peripheral region of the electrophotographic film 24 adjacent to the mask 90 is rapidly dried.

When the pressures of the pressurized squeezing air and the pressurized seal air are changed cyclically as explained before, a periodic pressure pulsation is generated which effectively and positively blows developer off the corners or minute gaps between the electrophotographic film 24 and the frame members contacting with the film 24, i.e., the upper frame member 90A, left and right frame members 90B, 90C and the lower frame member 90D of the mask 90.

The supply of the squeezing air and the seal air is controlled by the charging/exposure process of the next film frame which is commenced as the photographing button is pressed at (II) in FIG. 16. The supply of the squeezing air and the seal air is stopped simultaneously with the start of the film moving motor C after elapse of a predetermined time from the moment (IIA in FIG. 16) at which the solenoid 234 of the film pressing mechanism is de-energized, whereby the developing and squeezing process is completed.

It will be understood that the provision of the developing electrode ensures a high quality of the developed image without suffering any edge effect. Fogging of the image also is prevented due to application of bias voltage to the developing electrode 96. It is also possible to improve the image reproducibility by applying to the developing electrode a pulse voltage of the same polarity as the toner particles.

The film moving motor C is stopped after the electrophotographic film 24 has been fed to the right as viewed in FIG. 6 by a distance corresponding to the pitch of the frames. Thus, when the motor C is stopped, the frame which was placed in the developing section 66 before the film feed is set in the drying section 68. When a predetermined time has passed after the stopping of the film moving motor C, the solenoid 234 of the film pressing mechanism is started at (IIB) in FIG. 16. At the same time, the air pump 181 shown in FIG. 12 is started so that heated air is supplied through the conduit 177. The heated air heated by the heater 179 is blown into the drying chamber 174 through the heated air outlet 176 of the drying section 68. The operation of the air pump 181 is under the control of the charging/exposure process of the frame commenced by pressing of the photographing button at (III) in FIG. 16. When the solenoid 234 of the film pressing mechanism is deenergized at (IIIA) in FIG. 16, the air pump 181 is stopped thereby completing the drying operation.

The temperature of the heated air supplied to the drying chamber 174 is sensed by the temperature sensor 182 so that the temperature is maintained constant by an automatic control.

The drying chamber is larger in size than the developing chamber so that the film which has been wetted through development can be dried entirely even at its peripheral edge portions.

Although in the above-described embodiment the drying air pump 181 is activated in response to the energization of the solenoid 234 of the film pressing mechanism and only when the film 24 is being pressed against the processing head 54, the air pump 181 may be operated at all times from the start of the operation of the apparatus.

After the solenoid 234 of the film pressing mechanism has been de-energized at the position (IIIA) in FIG. 16, the film moving motor (C) is activated, and the frame which has been positioned at the drying section 68 is thereby moved to the fixing section 70. After the drive of the film moving motor (C) has been suspended, the solenoid 234 of the film pressing mechanism is energized at the position (IIIB) in FIG. 16 and, at the same time, the air pump 195 shown in FIG. 13 is activated to supply cold air to the space 190 in the fixing section 70. The cold air supplied to the space 190 passes through the area defined at the upper edge of the glass plate 186 to reach the fixing chamber 188.

When a predetermined period of time has elapsed after the solenoid 234 of the film pressing mechanism has been energized, the xenon lamp 192 is turned ON, so that the toner particles are fused and fixed to the surface of the film 24, thus completing the fixing step.

Any matter which is vaporized or scattered during the fixing operation is blown off by means of the cold air supplied from the air pump 195, and there is no fear of such matter adhering to the surface of the glass plate 186.

When the above-described steps are finished, the recording of an image on the electrophotographic film 24 is completed.

In the apparatus according to this embodiment, when the recording button is pressed, recording is started, and after the recorded frame positioned at the charging exposure section 64 has been moved to the developing section 66 and when a predetermined period of time has elapsed after the solenoid 234 of the film pressing mechanism has been energized, it becomes possible to record a subsequent frame. To effect continuous recording of following consecutive frames, the recording button is pressed during the period which begins when it becomes possible to record a subsequent frame and which ends when a predetermined period of time has elapsed after the completion of the application of a relatively weak blast to the developing section 66 by the pressure squeezing air pump 144. In consequence, the recording step is repeated, and the processing proceeds as shown in FIG. 16.

When the recording button is not pressed during said period, or when the command to end a series of recording operations is input from the control keyboard 28, the application of a relatively strong blast by the air pump 144 is suspended in accordance with the operation of a timer, and the drying and fixing operations carried out thereafter are also executed in accordance with the timer.

It is possible to project the film 24 having images of documents recorded thereon as described above, when the reader mode is selected. The electrophotographic apparatus described hereinbefore is so designed that it automatically select the reader mode when the cassette is mounted in the manner described. It is to be understood that the third mirror 38 has been moved from the position shown in FIG. 2 to another position). When the desired frame has been moved to and stopped at the charging/exposure section 64, the light source of the projection light source section 46 shown in FIG. 3 is turned on and the light emitted from the light source is applied through the through-hole 200 in the pressing plate 198 to the electrophotographic film 24. The light transmitted through the film 24 is projected through the optical system shown in FIG. 3 onto the screen 16, whereby the image of this frame of the film 24 is projected in a larger scale on the screen 16, Simultaneously with the turning on of the projecting light source, the air pump 89 shown in FIG. 7 is started so as to supply cooling air to the charging/exposure chamber 72 so as to prevent the electrophotographic film 24 from overheating due to the heat from the projecting light source section 46. This in turn eliminates any out-of-focus state which may otherwise be caused due to thermal distortion of the electrophotographic film.

In the reader mode, it is possible to continuously view projected images of the film 24 within a shout period of time by successively advancing the film 24 for each frame through the control keyboard 28. In such case, every time the film 24 is moved, the shutter (A) is closed in order to prevent flickering due to persistence phenomenon.

When the copy button on the control keyboard 28 is pressed while an image is being projected on the screen 16, the copy mode is selected. In consequence, the copy mirror 52 is moved, and the image being projected on the screen 16 is recorded on a sheet of copying paper 30 by the optical system shown is FIG. 4.

A second embodiment of the invention will be described hereinunder with specific reference to FIGS. 17 and 18.

In this embodiment, the processing of the electrophotographic film 24 in the developing section is conducted under the control of a microcomputer 300.

Figure 17:
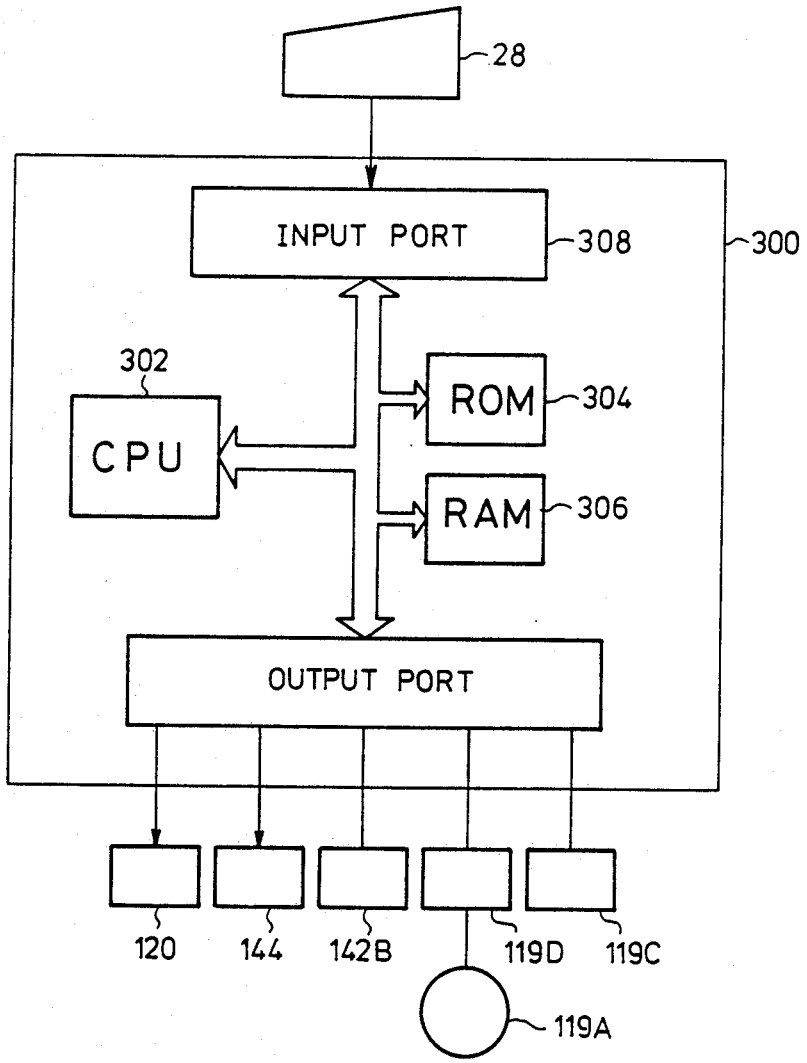
FIG. 17 is a block diagram of a second embodiment of the present invention.

As shown in FIG. 17, the microcomputer 300 includes a CPU 302, ROM 304, ROM 306, an input port 308 and an output port 310. These constituents are connected through a BUS 312. A control keyboard 28 is connected to the input port 308 so that signals input through the keyboard 28 is delivered to the CPU 302.

To the output port 310 are connected the solenoid valve 120, pressurized squeezing air pump 144, solenoid valve 142B, change-over switch 119D for switching the pressurized seal air pump 119A between high- and low-pressure modes, and the solenoid valve 119C. The operation is conducted as follows in accordance with the program stored in the ROM 304. Though the output signals of the blip sensor 196 and the like in addition to the input signals input through the control keyboard 28 are also input to the input port 308, they are not concerned directly with the present invention and are omitted from FIG. 17. Further, the arrangement of the output side of the microcomputer 300 which is not concerned directly with the present invention is omitted from FIG. 17.

Figure 18:
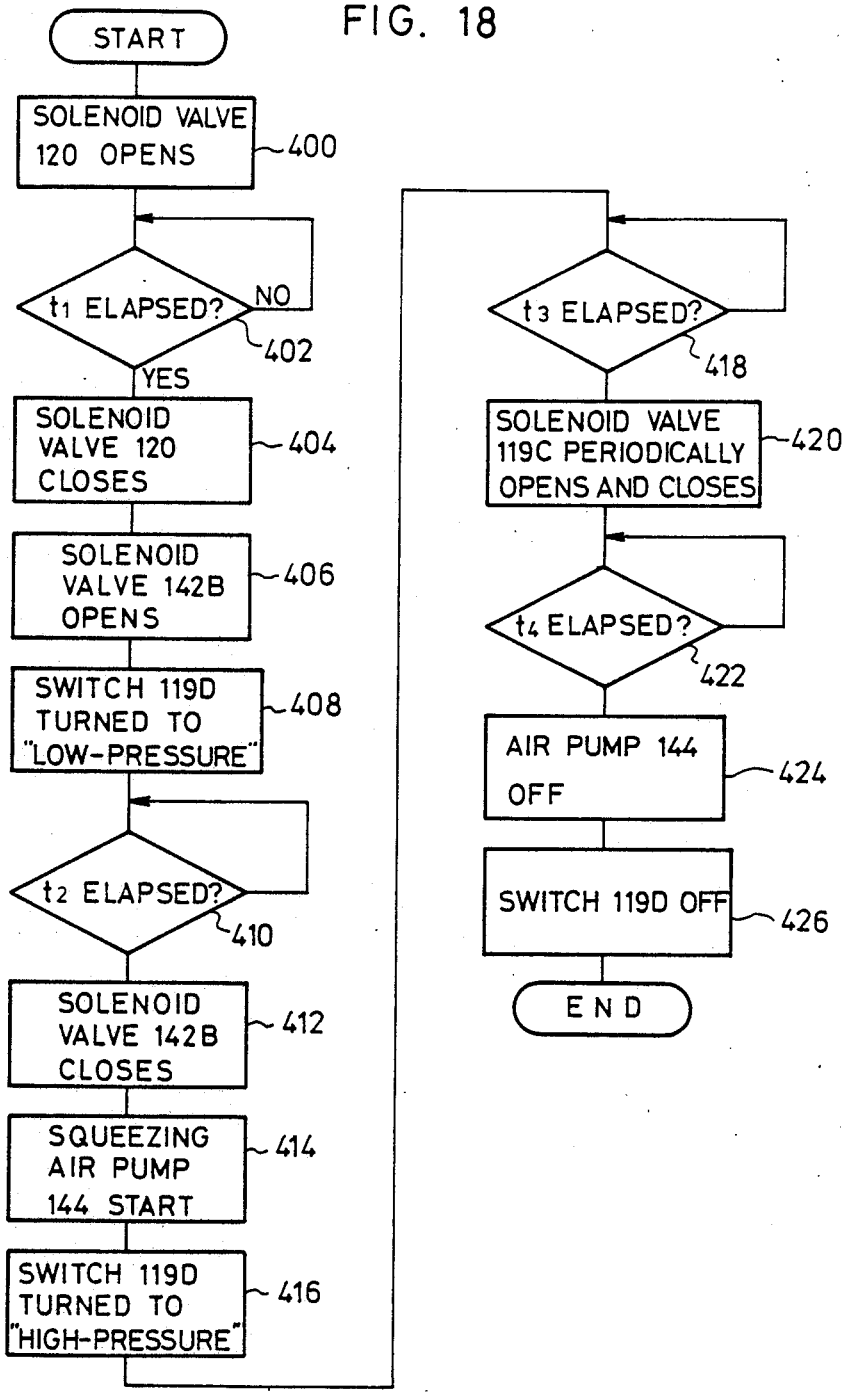
FIG. 18 is a flow chart showing an operation of the second embodiment.

FIG. 18 is a flow chart illustrating the operation performed in this embodiment.

It is assumed here that a frame of the electrophotographic film 24 after the charging/exposure has been already set in the developing section 66. Then, in Step 400, the solenoid valve 120 is opened to commence the supply of the developer. In Step 402, judgment is conducted as to whether a predeterined time $t_1$ hs elapsed, the process answer is yes, i.e., if the time $t_1$ has elapsed, the process proceeds to Step 404 in which the solenoid valve 120 is closed so as to stop the supply of the developer. At the same time, in Step 406, the solenoid valve 142B is opened so that the atmospheric air is supplied into the developing chamber 98. In Step 408, the change-over switch 19D is turned to select the low-pressure mode so that the pressurized seal air pump 119A is started in this mode so as to supply the seal air to the recess 92 at the low pressure. In Step 410, a judgment is conducted as to whether a predetermined time $t_2$ has passes after the turning of the switch 119D to the low-pressure mode side. If the answer is YES, the solenoid valve 142B is closed in Step 412. Then, the air pump 144 is started in Step 414 so as to supply pressurized air to the developing chamber 98. In Step 416, the switch 119D is turned from the low-pressure mode side to the high-pressure mode side, so that seal air is supplied to the recess 92 at a pressure which is higher than that produced by the air pump 144. In Step 418, a judgment is conducted as to whether a predetermined time $t_3$ has passed after the turning of the switch 119D to the high-pressure-mode side. An affirmative answer to this question proceeds to process to Step 420 in which the solenoid valve 119C is opened and closed cyclically. When the elapse of a predetermined time $t_4$ after the start of the cyclic operation of the solenoid valve 119C is confirmed in Step 422, the process proceeds to Step 424 in which the pump 144 is turned off and, at the same time, the switch 119D is turned off to stop the pump 119A in Step 426, thus completing the developing process.

Although the invention has been described through its preferred form, the described embodiment is only illustrative and various changes and modifications may be imparted thereto without departing from the scope of the invention which is limited solely by the appended claims.

What is claimed is:

1. A process head for use in an electrophotographic apparatus and adapted to supply a developer to an electrophotographic film in a developing section of said electrophotographic apparatus thereby developing a latent image on said electrophotographic film, said process head comprising:

a seal section provided adjacent to said developing section and separated from said developing section by a frame portion which defines said developing section; and seal pressure supply means capable of supplying to said seal section a seal gas selectively at a first pressure which is higher than the pressure in said developing section and, hence, effective to prevent said developer from leaking out said developing section and at a second pressure which is higher than said first pressure and, hence, effective to drive said gas into said developing section from said seal section beyond said frame portion.

2. A process head for use in an electrophotographic apparatus according to claim 1, wherein said seal pressure supply means has means for changing said second pressure of said gas.

3. A process head for use in an electrophotographic apparatus according to claim 1, wherein said seal pressure supply means includes an air pump for supplying said seal gas to said seal section, and switching means for switching the pressure of said seal gas between said first pressure and said second pressure.

4. A process head for use in an electrophotographic apparatus according to claim 3, wherein said seal pressure supply means includes a conduit connected between said air pump and said seal section, a branch passage branching from said conduit, and a valve disposed in said branch, whereby the change in said second pressure is effected by opening and closing action of said valve.

5. A process head for use in an electrophotographic apparatus according to claim 1, wherein said seal pressure supply means is designed such that it supplies said seal gas to said seal section while a pressurized squeezing gas is being supplied to said developing section after stop of supply of said developer to said developing section.

6. A process head for use in an electrophotographic apparatus according to claim 5, wherein said seal pressure supply means is so designed that it supplies said seal gas at said first pressure for a first predetermined time and then at said second pressure for a second predetermined time.

7. A process head for use in an electrophotographic apparatus according to claim 5, wherein said seal pressure supply means is so designed that it cyclically changes said second pressure of said seal gas.

8. A process head for use in an electrophotographic apparatus and adapted for conducting various types of processing on an electrophotographic film, comprising:

a developing section for supplying said electrophotographic film with a developer thereby developing a latent image on said electrophotographic film;

frame means defining said developing section;

a seal section adjacent to said developing section and separated from said developing section by said frame means;

pressurized squeezing air supply means for supplying said developing section with a pressurized squeezing air; and seal pressure supply means for supplying a sealing gas to said seal section selectively at a low pressure which is higher than the pressure in said developing section and, hence, effective to prevent said developer from leaking from said developing section and at a high pressure which is higher than said low pressure and, hence, effective to drive said seal gas into said developing section beyond said frame means.

9. A process head according to claim 8, wherein said seal section is constituted by a recessed groove formed around said frame means.

10. A process head according to claim 8, wherein said seal pressure supply means includes an air pump supplying said seal gas to said seal section and a change-over switch for switching the pressure of said seal gas between said low pressure and said high pressure.

11. A process head according to claim 10, wherein said seal pressure supply means includes a seal gas supply conduit, a branch branching from said conduit and communicating with the atmosphere, and a valve for selectively opening and closing said branch, whereby said high pressure is changed by opening and closing operation of said valve.

12. A process head according to claim 8, wherein said seal pressure supply means supplies said seal gas to said seal section at said low and high pressures in synchronism with the operation of said pressurized squeezing air supply means.

13. A process head according to claim 12, wherein said seal pressure supply means is constructed so as to change said high pressure of said seal gas cyclically.

* * * * *